United States Patent [19]

Iijima et al.

[11] 4,020,745

[45] May 3, 1977

[54] POWER SLIDE MECHANISM

[75] Inventors: Katsuhiko Iijima; Katsumasa Jomen, both of Sagamihara, Japan

[73] Assignee: Mitsubishi Jukogyo Kabushiki Kaisha, Tokyo, Japan

[22] Filed: Oct. 9, 1975

[21] Appl. No.: 621,232

[30] Foreign Application Priority Data

Nov. 5, 1974 Japan ..... 49-126532

[52] U.S. Cl. ..... 91/217; 92/117 R; 92/161; 214/138 C

[51] Int. Cl.[2] ..... F01B 15/02

[58] Field of Search ..... 92/117, 146, 161; 91/217, 216; 61/45 D; 214/138 C

[56] References Cited

UNITED STATES PATENTS

| | | | |
|---|---|---|---|
| 2,444,474 | 7/1948 | Somes et al. | 92/117 A |
| 2,657,009 | 10/1953 | Neis et al. | 92/117 R |
| 2,938,706 | 5/1960 | Langen | 92/117 R |
| 3,160,074 | 12/1964 | Leander et al. | 92/217 |
| 3,263,573 | 8/1966 | Fogelstrom et al. | 91/217 |
| 3,333,424 | 8/1967 | Keil | 61/45 D |

*Primary Examiner*—Irwin C. Cohen
*Attorney, Agent, or Firm*—Cushman, Darby & Cushman

[57] ABSTRACT

A power slide mechanism comprising a supporting frame, a moving frame mounted slidable on said supporting frame, double-acting fluid pressure device including a cylinder, a piston fitted slidably in the cylinder and a respective piston rod fixed to the piston at each end thereof and penetrating through the cylinder so that one end of each piston rod projects from respective end face of the cylinder, and a respective engaging and fastening device mounted at each end of the supporting frame and adapted to releasably engage the free end of a respective one of the piston rods.

4 Claims, 15 Drawing Figures

-FIG. 4.-
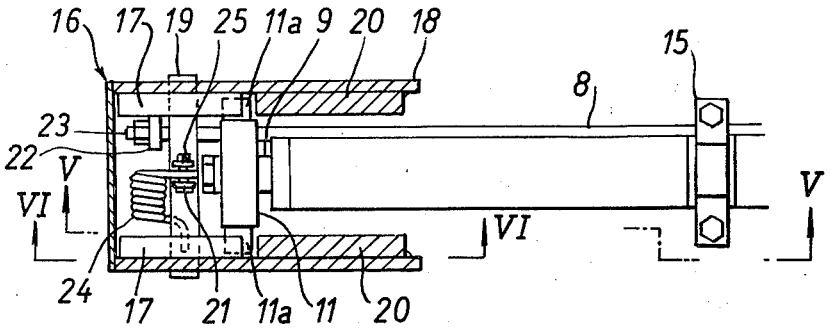
-FIG. 5.-
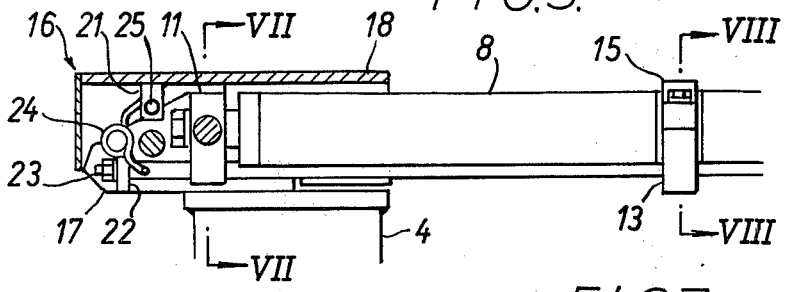
-FIG. 7.-
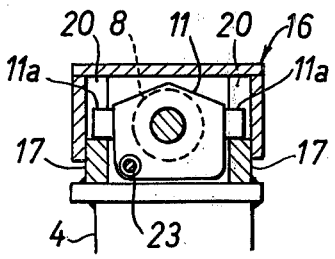
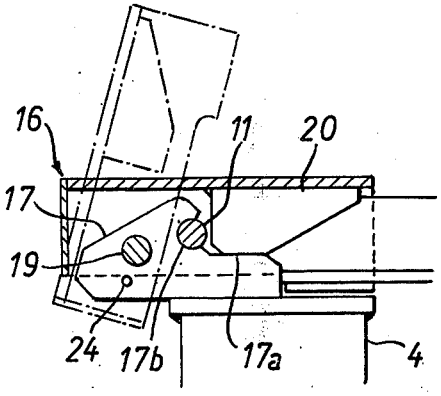
-FIG. 6.-
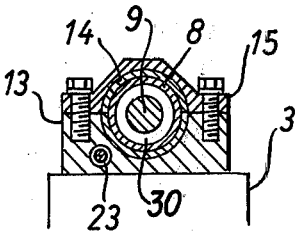
-FIG. 8.-

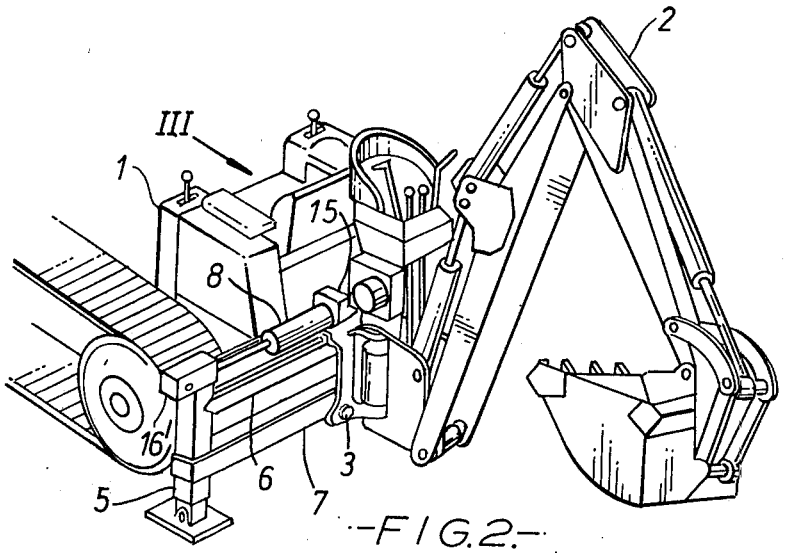
-FIG.2.-
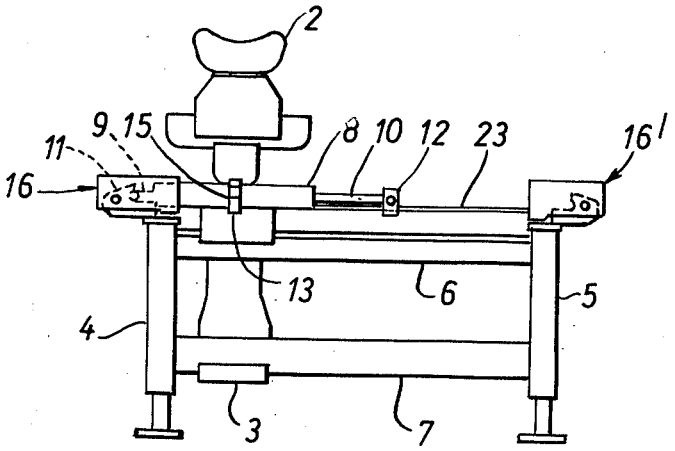
-FIG.3.-

POWER SLIDE MECHANISM

This invention relates to improvements in a power slide mechanism in which a moving frame is slidably mounted on a supporting frame of a cross beam-like form for movement by a fluid pressure cylinder device attached to said moving frame.

Power slide mechanisms having a structure such as mentioned above have heretofore been known in the art and one such mechanism is described hereinafter with reference to FIGS. 1A to D of the accompanying drawings, which represent an elevation of a known mechanism in which the moving frame is shown in four different positions.

In FIG. 1 a supporting frame *a* of a cross beam-like form has longitudinal supporting frames (not shown) at both the ends thereof, and a moving frame *b* is slidably mounted on the supporting frame *a*. An oil pressure cylinder *c* has a piston rod *d* projecting from the left end face of the cylinder *c*, and the top end of the piston rod *d* is fixed to the left end of the supporting frame by a fixing mounting *e*. Attachment brackets *f* and *g* are fixed to the left and right ends of the cylinder *c* attaching of the moving frame to the cylinder *b*. Pins *h* and *i* are releasably mounted in position as shown to dismountably fix one of the attachments *f* and *g* and the moving frame *b*. When the oil pressure cylinder *c* is contracted as shown in FIG. 1-A, the attachment *f* and the moving frame *b* are fixed by pins *h* and *i*. Then, the oil pressure cylinder *c* is elongated as shown in FIG. 1-B, whereby the moving frame *b* and excavator (not shown) mounted thereon are shifted to the central portion of the supporting frame *a*. Thereafter, the pins *h* and *i* are dismounted from the attachment *f* and the moving frame *b*, and the oil pressure cylinder *c* is contracted as shown in FIG. 1-C and the attachment *g* and the moving frame *b* are fixed by means of the pins *h* and *i*. Then, the oil pressure cylinder *c* is elongated as shown in FIG. 1-D, whereby the moving frame *b* and the excavator attached thereto are shifted to the right end of the supporting frame *a*. When the above procedures are repeated in the same manner but in a reverse order, the moving frame *b* and the excavator are shifted to the left end of the supporting frame *a*.

In the conventional power slide mechanism having the above structure, the pins *h* and *i* are selectively inserted into pin holes of either of the attachments *f* and *g* mounted at both the ends of the oil pressure cylinder *c* to thereby fix the moving frame *b* and the oil pressure cylinder *c*. In this structure, the excavator can slide along the member *a* a distance about 2 times the stroke distance of the oil pressure cylinder *c*, but if the pin holes of the moving frame *b* are not well in alignment with the pin holes of the attachment *f* or *g*, the pins *h* and *i* cannot be properly inserted. Further, this operation of making the pin holes of the moving frame well in alignment with the pin holes of the attachment *f* or *g* to facilitate insertion of the pins *h* and *i* is very difficult in a working field of a bad foothold or the like. Moreover, such conventional power slide mechanism is defective in that the excavator cannot be moved accurately and quickly.

According to the present invention there is provided a power slide mechanism comprising a supporting frame, a moving frame mounted slidably on said supporting frame, double-acting fluid pressure device including a cylinder, a piston fitted slidably in the cylinder and a respective piston rod fixed to the piston at each end thereof and penetrating through the cylinder so that one end of each piston rod projects from respective end face of the cylinder, and a respective engaging and fastening device mounted at each end of the supporting frame and adapted to releasably engage the free end of a respective one of the piston rods.

For a better understanding of the present invention and to show how it may be carried into effect, reference will now be made, by way of example, to the accompanying drawings, in which:

FIG. 2 is a perspective view illustrating a power slide mechanism according to this invention.

FIG. 3 is an enlarged front view seen from the direction of arrow III in FIG. 2.

FIG. 4 is a cross-sectional plane view showing an engaging and fastening device of the power slide mechanism of FIG. 1.

FIG. 5 is a front view illustrating the section taken along the line V—V in FIG. 4.

FIG. 6 is a front view illustrating the section taken along the line VI—VI in FIG. 4.

FIG. 7 is a side view illustrating the section taken along the line VII—VII in FIG. 5.

FIG. 8 is a side view illustrating the section taken along the line VIII—VIII in FIG. 5.

Figure 1A:
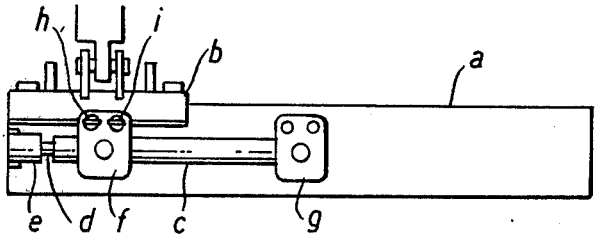
FIG. 1A PRIOR ART
FIGS. 1A through 1D are diagrammatic, fragmentary rear elevation views illustrating the function and operation of a conventional power slide mechanism for an excavator.
Figure 1B:
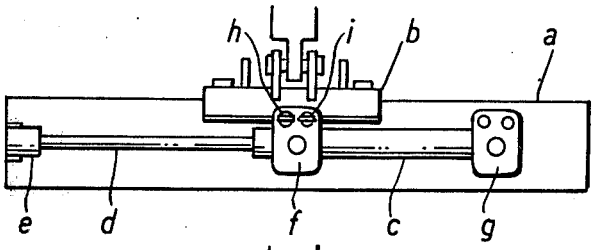
FIG. 1B PRIOR ART
Figure 1C:
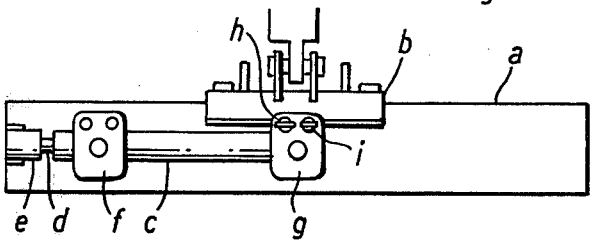
FIG. 1C PRIOR ART
Figure 1D:
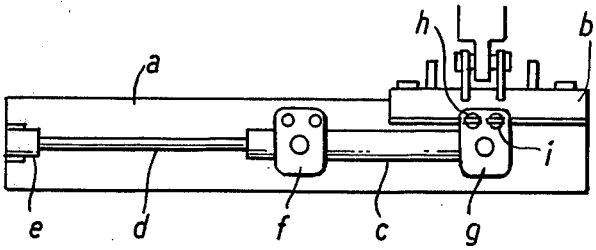
FIG. 1D PRIOR ART

In FIG. 2, an excavator 2 is mounted on a moving frame for transverse sliding movement on transverse supporting frames 6 and 7 of a tractor 1. In FIGS. 2 and 3 it can be seen that the transverse frames 6 and 7 are carried by vertical supporting frames 4 and 5. The moving frame 3 is so arranged that it can be moved in both leftward and rightward directions while being guided by the transverse supporting frames 6 and 7. Piston rods 9 and 10 project from respective end faces of an oil pressure cylinder 8. A double-rod type double-acting oil pressure cylinder is used as the cylinder 8 in this embodiment. As illustrated in detail in FIG. 8, the cylinder 8 is fixed to the moving frame 3 by means of a bracket 13 fixed to the moving frame 3, a push rod 14 and a cap 15. Trunnions 11 and 12 (FIG. 3) are attached to outer ends of the piston rods 9 and 10, respectively. Reference numerals 16 and 16' in FIGS. 2 and 3 denote automatic engaging and fastening devices for the trunnions 11 and 12 which are disposed respectively on left and right sides of the moving frames 4 to 7. Details of the devices 16 and 16' are illustrated in FIGS. 4 to 7. Both the devices 16 and 16' have the same structure, which will now be described mainly by reference to the device 16. Brackets 17 are fixed to the upper end of the vertical supporting frame 4, and a pin 19 is laid between the brackets 17. A cover 18 is attached to the pin 19, which is arranged so that it can rotate from the position indicated by the solid line in FIG. 6 to the position indicated by the double-dotted chain line in FIG. 6. The trunnion 11 has shaft portions 11*a* at both the end thereof. Each bracket has a guide face 17*a* for guiding the shaft portion 11*a* of the trunnion and a receiving portion 17*b* for receiving the portion 11 of the trunnion other than the shaft portion 11*a*.

The cover 18 includes two side face plates, an upper face plate and a left end face plate. Plates 20 are fixed in the state contacted with one or other of the side face plates and the upper face plate, and a boss 21 is fixed to the center of the upper face plate. One end of a spring 24 is inserted into a hole of one of the brackets 17 and the other end of the spring 24 is inserted into a hole of the boss 21. The cover 18 is always biased to a position indicated in FIG. 5 by the action of the spring 24. Another boss 22 is fixed to the other bracket 17, and a guide rod 23 is laid between this boss 22 and a similar boss 22' of the automatic engaging and fastening device 16' mounted on the right side of the supporting frames 4 to 7. This guide rod 23 is inserted into holes perforated on the trunnions 11 and 12 and a hole perforated in said bracket 13 (see FIGS. 7 and 8) so as to act as a guide for the trunnions. Swinging of the piston rods 9 and 10 during telescopic movement of the pistons is prevented by this guide rod 23.

Figure 9A:
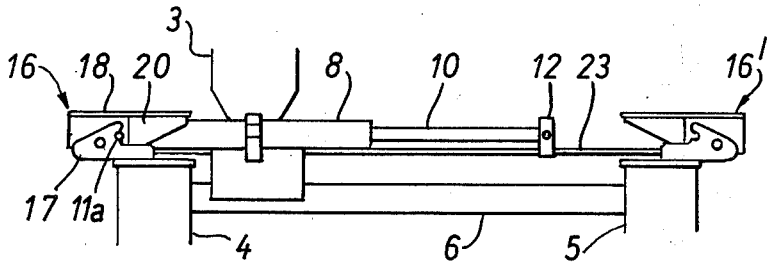
FIGS. 9A through 9D are diagrammatic, fragmentary rear elevation views illustrating successive steps in the operation of the power slide mechanism of the present invention.
Figure 9B:
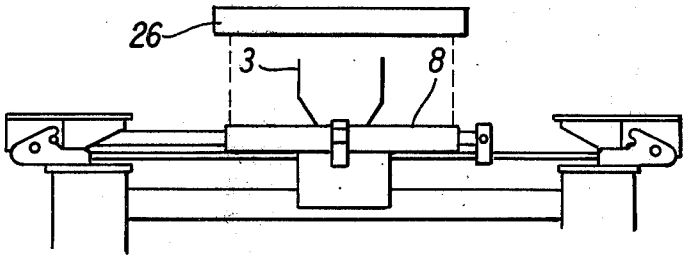
Figure 9C:
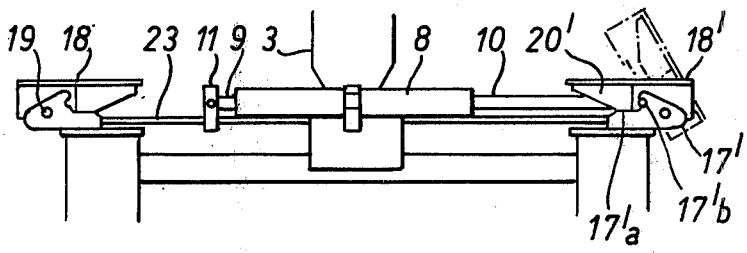
Figure 9D:
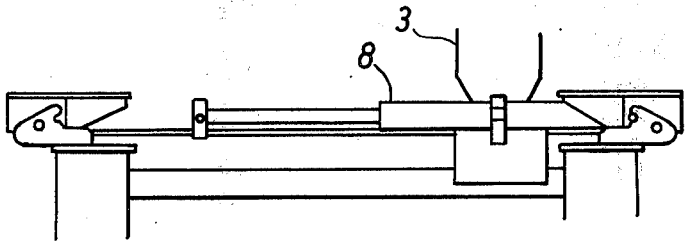

The operation of the power slide mechanism having the above structure will now be described by reference to FIG. 9.

FIG. 9-A illustrates the state where the shaft portion 11*a* of the trunnion 11 is held and fixed by the automatic engaging and fastening device 16, namely by the bracket 17 and plate 20 of the device 16 (see the position indicated by the solid line in FIG. 6). In this state, the excavating device 2 and the moving frame 3 to which the cylinder 8, is attached, are disposed on the left hand side of the supporting frames 6 and 7, and a piston 30 of the piston rods 9 and 10 fitted in the oil pressure cylinder 8 is located in the vicinity of the right end of the oil pressure cylinder 8. In this state, if compressed air is fed from selective-pressure applying means 26 into the oil pressure cylinder 8 at a position further rightwards than the position of the piston, the oil pressure cylinder 8 and the moving frame 3 are shifted in towards the right to the position shown in FIG. 9-B, whereby the excavating device 2 is shifted to the center of the supporting frames 6 and 7. Then, the cover 18 is rotated and opened to the position indicated by the double dotted line in FIG. 6 with the pin 13 being at the center, whereby the trunnion 11 is released from the engagement and fastening and the piston rod 9 is made free. Then, the compressed air is fed into the oil pressure cylinder 8 at a position further to the left than the position of the piston, whereby the piston rods 9 and 10 are shifted in towards the right along the guide rod 23 to the position indicated in FIG. 9-C. At this moment, the shaft portion 12*a* of the trunnion 12 of the piston rod 10 impinges against the downwardly inclined face of the plate 20' of the automatic engaging and fastening device 16' to push the cover 18' against the spring 24' and it further advances until it is contacted with the guide face 17'*a* of the bracket 17', whereby the trunnion 12 is received in the receiving portion 17'*b* of the bracket 17'. When the trunnion 12 is received in the receiving portion 17'*b*, the cover 18' is closed by the action of the spring 24' and the trunnion 12 (piston rod 10) is thus fixed. Then, the compressed oil is fed into the oil pressure cylinder 8 at a position further to the right than the position of the piston, thereby to shift the oil pressure cylinder 8 and moving frame 3 in towards the right to the position shown in FIG. 9-D. Accordingly, the excavating device 2 is shifted to the right side of the supporting frames 6 and 7. The above illustration has been made with respect to the rightward movement of the device 2. The leftward movement of the excavating device 2 from the right side to the left side can be accomplished by performing the above procedures similarly but in a reverse order.

Thus there is provided a powder slide mechanism for an excavator which can slide the excavator promptly and assuredly with ease. The power slide mechanism also has a simple structure and can be manufactured at a low cost.

Further, in the power slide mechanism of this invention, since the excavator can be slided by moving the cylinder along the distance corresponding to ½ of the sliding distance of the supporting frame, the size of the entire apparatus can be reduced and the structure can be simplified. Accordingly, the power slide mechanism of this invention can be provided at a low cost.

What we claim is:

1. A power slide mechanism, comprising:

an elongated, generally horizontal frame having a left end and a right end;

latch means provided at each end of the elongated frame;

an equipment mounting frame mounted on the elongated frame for movement generally horizontally therealong parallel to the sense of elongation of the frame from adjacent one end to adjacent the other end of the elongated frame;

a hydraulic cylinder having a piston slidably received therein and a piston rod extending from each end of the hydraulic cylinder, the aggregate length of the piston and two piston rods being less than the distance between the two latch means on the elongated frame;

means fixing the hydraulic cylinder, generally horizontally on the equipment mounting frame parallel to the sense of elongation of the elongated frame, so that one piston rod thereof extends leftwards and the other extends rightwards;

cooperating latch means provided at the outer ends of the two piston rods, for latching with and unlatching from the respective latch means at the left and right ends of the elongated frame;

means for selectively applying hydraulic pressure to either side of the piston to relatively extend one piston rod and correspondingly retract the other piston rod, and vice versa; and the cooperating latch means provided at the outer ends of the two piston rods for latching with and unlatching from the respective latch means at the left and right ends of the elongated frame thus constituting a left frame latch paired with a left piston rod latch and a right frame latch paired with a right piston rod latch;

one latch of each pair comprising a normally closed catch including a pivotally mounted portion pivotable for opening the catch toward the other latch of the same pair; and the other latch of each pair comprising pin means retainable in the normally closed catch of said one latch of the respective pair.

2. The power slide mechanism of claim 1, wherein:

said normally closed catch pivotally mounted portion includes a camming surface which faces the pin means of said other latch of each respective pair when that pair of latches is in a disengaged condition, and said normally closed catch includes a receiver therewithin having surface means which provides a positive stop against withdrawal of the respective pin means and against pin withdrawal initiated opening of the respective normally closed catch, whereby the respective normally closed catch, when the camming surface thereof is engaged by the respective pin means, by extension of the respective piston, the respective catch will temporarily open to accept and retain the respective pin means.

3. The power slide mechanism of claim 2, wherein:

each normally closed catch includes a spring bearing against the respective pivotally mounted portion for normally maintaining that catch closed.

4. The power slide mechanism of claim 2, wherein:

said catches are provided on the respective of said left and right frame latches.

* * * * *